US007156704B2

(12) United States Patent
Shimizu

(10) Patent No.: US 7,156,704 B2
(45) Date of Patent: Jan. 2, 2007

(54) TERMINAL FITTING AND A CONNECTOR USING SUCH A TERMINAL FITTING

(75) Inventor: Tooru Shimizu, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 11/230,128

(22) Filed: Sep. 19, 2005

(65) Prior Publication Data

US 2006/0068650 A1 Mar. 30, 2006

(30) Foreign Application Priority Data

Sep. 29, 2004 (JP) ..... 2004-313087
Sep. 29, 2004 (JP) ..... 2004-313088

(51) Int. Cl.
*H01R 11/22* (2006.01)

(52) U.S. Cl. ..... 439/852

(58) Field of Classification Search ..... 439/852, 439/842, 862, 595; 429/752
See application file for complete search history.

(56) References Cited

U.S. PATENT DOCUMENTS 3,781,760 A * 12/1973 Mancini et al. ..... 439/595
5,281,175 A * 1/1994 Chupak et al. ..... 439/839
6,244,910 B1 6/2001 Grubbs
6,305,992 B1 * 10/2001 Bouda et al. ..... 439/834
6,520,811 B1 2/2003 Mitani et al.
6,527,601 B1 3/2003 Chen
6,645,003 B1 * 11/2003 Yoshida et al. ..... 439/507
6,971,927 B1 * 12/2005 Anbo et al. ..... 439/852

FOREIGN PATENT DOCUMENTS

DE 1 522 286 8/1978
JP 11-224709 8/1999
WO WO 00/74176 A1 12/2000

* cited by examiner

*Primary Examiner*—Tho D. Ta
*Assistant Examiner*—Vanessa Girardi
(74) *Attorney, Agent, or Firm*—Gerald E. Hespos; Anthony J. Casella

(57) ABSTRACT

A female terminal fitting (12) has tube (19) for receiving a male terminal fitting (10). A main spring (27) is cantilevered forwardly from the tube (19) and an auxiliary spring (30) is cantilevered forwardly at the outer side of the main spring piece (27). Stoppers (32) bulge out from the opposite sides of the auxiliary spring (30) for preventing the auxiliary spring (30) from being displaced up when the free end of the auxiliary spring (30) is thrust up from the outer side. Receiving portions (33) are left in the tube (19) during the forming of the auxiliary spring (30) and contact the stoppers (32). Thus, even if an external matter strikes against the auxiliary spring (30), the auxiliary spring (30) will not deform excessively in thrust-up direction.

9 Claims, 9 Drawing Sheets

TERMINAL FITTING AND A CONNECTOR USING SUCH A TERMINAL FITTING

BACKGROUND OF THE INVENTION

1. Field of the Invention

The invention relates to a terminal fitting and a connector using such a terminal fitting.

2. Description of the Related Art

Japanese Unexamined Patent Publication No. H11-224709 discloses a terminal fitting with a tubular portion for receiving a mating terminal. A resiliently deformable spring piece is provided in the tubular portion and an auxiliary spring is a cantilevered forward at the outer side of the spring piece. The mating terminal is inserted into the tubular portion and deforms the spring piece. Thus, the deformed spring piece is urged resiliently against the mating terminal fitting to establish electrical connection. Additionally, the auxiliary spring contacts the spring piece from the outer side to reinforce the resilient force of the spring piece.

However, the auxiliary spring piece is exposed at the side surface of the tubular portion in the above construction. As a result, external matter can strike and deform the auxiliary spring.

The invention was developed in view of the above problem and an object thereof is to provide a terminal fitting that prevents a spring portion from being deformed excessively and a connector using such a terminal fitting.

SUMMARY OF THE INVENTION

The invention relates to a terminal fitting, comprising a tube for receiving a mating terminal. A spring is exposed at a side surface of the tube. The spring includes at least one stopper, and the tube includes at least one receiving portion disposed to contact the stopper for preventing displacement of the spring inwardly when the spring is forced in from an outer side.

The spring preferably has a free front end.

The spring preferably has a main spring that is cantilevered forward in the tube and an auxiliary spring that is cantilevered forward at the outer side of the main spring.

The auxiliary spring preferably is formed by making a cut in a surface of the tube that faces the main spring and bending a cut portion.

The stopper preferably bulges out from at least one of the opposite sides of the auxiliary spring with respect to the width direction. A receiving portion is formed at an opening edge of the stopper that is left in the tube by forming the auxiliary spring through cutting and bending.

The stopper preferably bulges out from the opposite sides of the auxiliary spring with respect to the width direction. The receiving portion preferably is an opening edge left in the tube by forming the auxiliary spring. Accordingly, excessive deformation of the auxiliary spring in a thrust-up direction can be prevented even when an external matter strikes against the spring. Further, separate processing steps are not required to form the receiving portion.

The invention also relates to a connector with the above-described terminal fitting. The terminal fitting has a tube for receiving a mating terminal fitting and a barrel for engaging a wire. The tube and the barrel define heights measured from a bottom surface of the terminal fitting. The height of the barrel exceeds the height of the tube. The connector also has a housing with a cavity for accommodating the terminal fitting. The cavity has a step at a boundary between a portion that accommodates the tube and a portion that accommodates the barrel. The height of the accommodating portion for the barrel exceeds the height of the accommodating portion for the tube.

A demand exists for smaller connectors, and the miniaturization of connectors results in smaller terminal fittings. The height of the barrel to be connected with a wire may exceed the height of the tube to be connected with the mating terminal fitting due to required dimensions of the wire. Outer surfaces of a female housing may be taller at a part corresponding to the barrel and shorter at a part corresponding to the tube in view of the height differences in the terminal fitting. The part of the female housing corresponding to the relatively short tube is fit into a receptacle of the male housing. Thus, the height of the connector can be reduced as compared to a case where the outer surfaces of the female housing conform to the height of the barrel.

The terminal fitting can collide with the step as the terminal fitting is inserted into the cavity. However, the terminal fitting prevents the spring from deforming excessively even if the spring and the step collide. Moreover, the height of the connector can be shortened.

The spring of the terminal fitting preferably is a main spring. The terminal fitting may further have an auxiliary spring cantilevered forward at the outer side of the main spring. A reinforcement preferably is provided for reinforcing the main spring and/or auxiliary spring. The reinforcement preferably is at the base end of the main spring and/or auxiliary spring and enhances the rigidity of the main spring and the auxiliary spring. Thus, a high contact pressure with the mating terminal can be obtained.

The reinforcement preferably comprises a bulge formed by embossing a flat surface of the main spring and/or auxiliary spring.

The spring preferably is cantilevered forward from the rear of the tube. The spring preferably has a first area extending substantially forward from the rear end, a second area extending from the front end of the first area, and a third area extending from the front end of the second area to the front end of the spring. The spring contacts the tube in the first area, is slightly distanced from the tube in the second area, and substantially contacts the tube at a boundary between the second and third areas.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
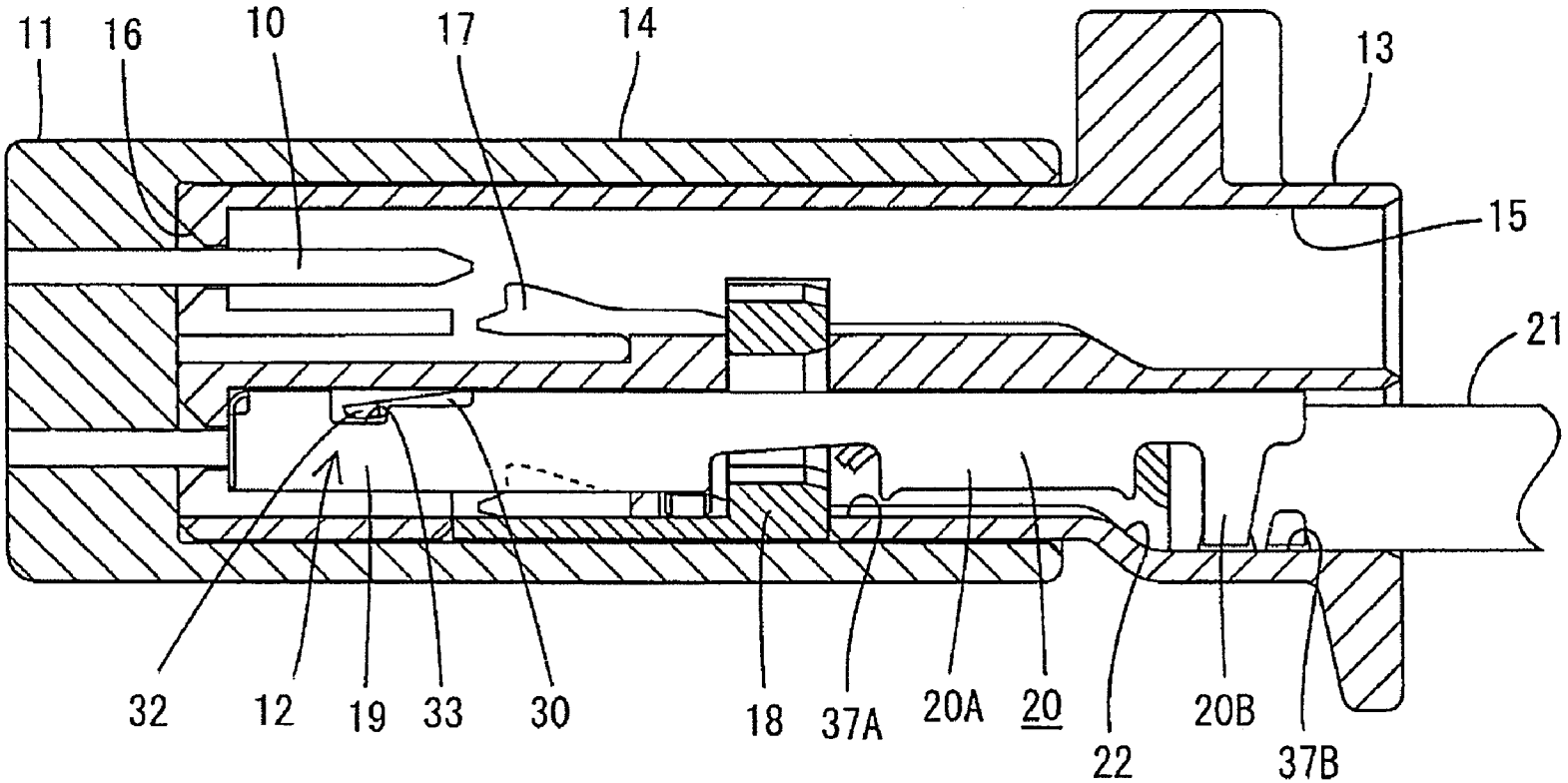
FIG. 1 is a section of a connector according to the invention.

A connector assembly according to the invention has male terminal fittings 10 disposed at two stages in a male housing 11 and female terminal fittings 12 disposed at two stages in a female housing 13, as shown in FIGS. 1 to 9. The two housings 11, 13 are connectable with and separable from each other. In the following description, connecting directions of the housings 11, 13 are referred to as the forward directions. Reference is made to FIG. 1 concerning the vertical direction of the housing, but reference is made to FIGS. 2 and 7 for the vertical direction of the female terminal fitting 12.

As shown in FIG. 1, the male housing 11 is made e.g. of a synthetic resin and includes a receptacle 14 with an open front end. The male terminal fittings 10 are mounted through the rear wall of the receptacle 14 and project into the receptacle 14.

The female housing 13 is made e.g. of a synthetic resin and has cavities 15 for accommodating the female terminal fittings 12. Insertion openings 16 for insertion of the male terminal fittings 10 are formed in the front wall of the female housing 13 and conform to the respective cavities 15.

The female terminal fitting 12 is inserted into each cavity 15 from behind while being turned upside down, and is locked by a lock 17 formed in the cavity 15 and by a retainer 18 inserted from below the female housing 13.

Figure 5:
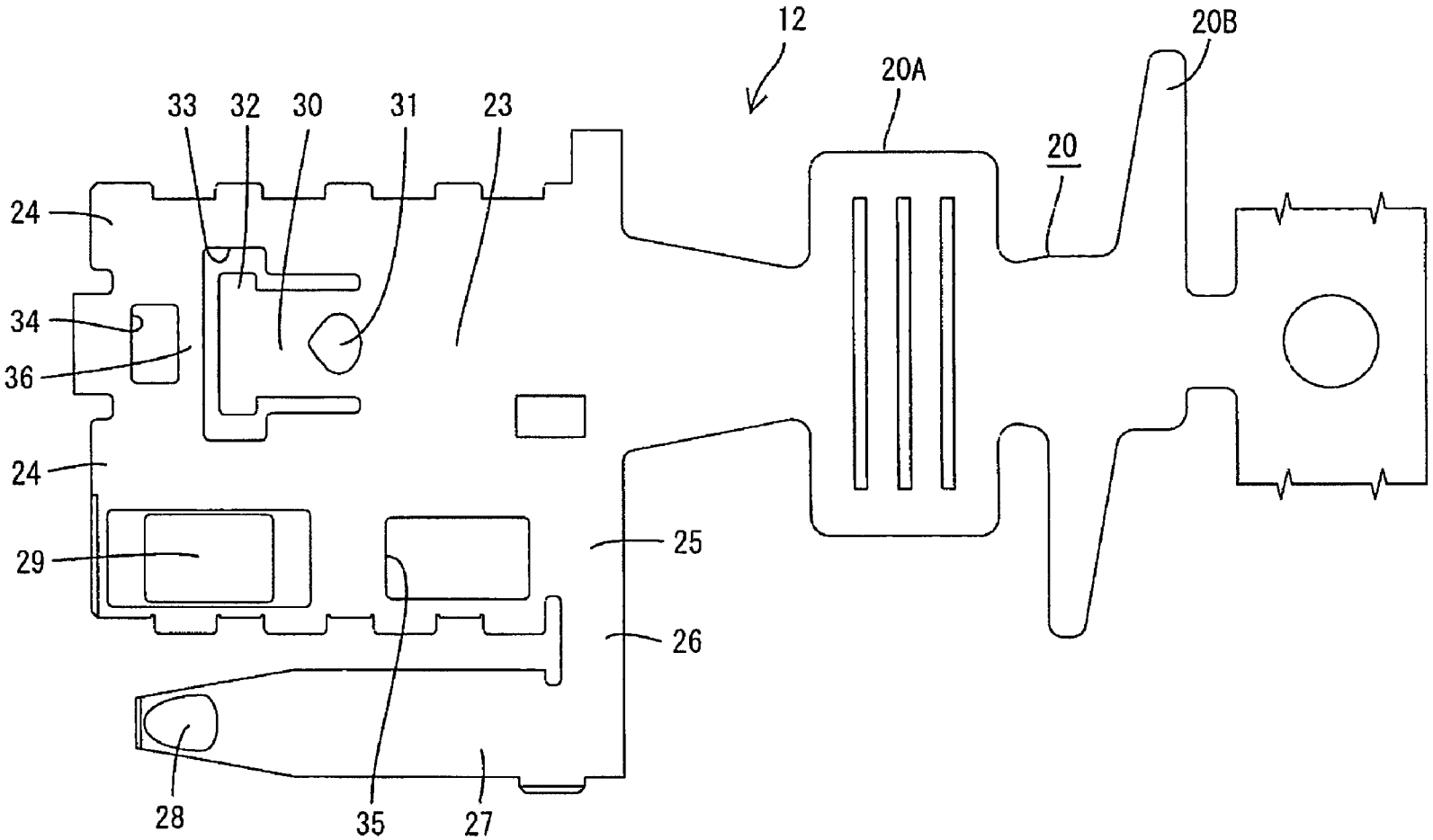
FIG. 5 is a development of the female terminal fitting.

Each female terminal fitting 12 is narrow and long along forward and backward directions, and is formed by bending, folding and/or embossing a conductive metal plate that has been stamped or cut into a specified shape (see FIG. 5). A substantially rectangular tube 19 is formed at the front of the female terminal fitting 12 and is configured for receiving the male terminal fitting 10. A barrel 20 is formed at the rear of the female terminal fitting 12.

Crimping pieces project from opposite lateral edges of a bottom plate of the female terminal fitting 12 along the barrel 20. The crimping pieces at the front of the barrel 20 define a wire barrel 20A and are configured to be crimped, bent or folded into connection with a core of the wire 21. The crimping pieces at the rear of the barrel 20 define an insulation barrel 20B and are configured to be crimped, bent or folded into connection with an insulation coating of the wire 21. The height of the wire barrel 20A is substantially equal to the height of the tube 19, but is less than the height of the insulation barrel 20B. Thus, a sloped step 22 is formed at the bottom surface of the cavity 15 at a boundary between an accommodating portion 37A for accommodating the tube 19 and the wire barrel 20A and an accommodating portion 37B for accommodating the insulation barrel 20B. On the other hand, the surface of the cavity 15 opposed to the step 22 defines a substantially uniform height along the front and rear accommodating portions 37A, 37B.

The outer surface of the female housing 13 is raised at a part corresponding to the insulation barrels 20B, but is lowered at a part corresponding to the tubes 19 in view of the height differences of the female terminal fittings 12 (see FIG. 1). Thus, a part of the female housing 13 corresponding to the relatively shorter tubes 19 is fit into the receptacle 14 of the male housing 11. Therefore, the height of the connector is short as compared to a case where the outer surface of the female housing 13 conforms to the height of the insulation barrels 20B.

Figure 2:
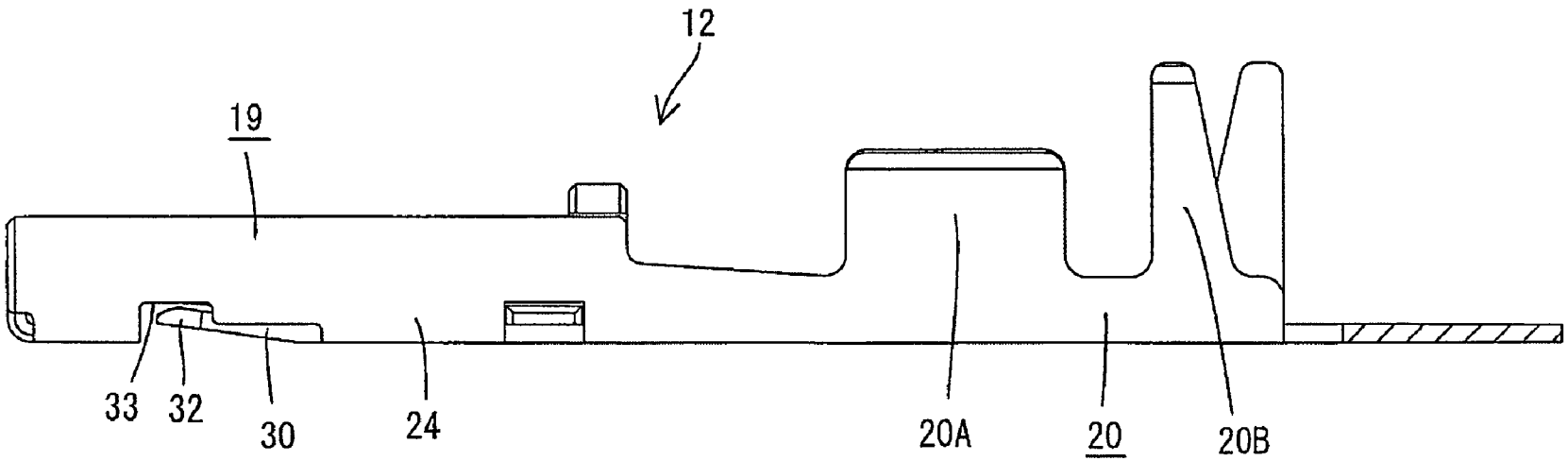
FIG. 2 is a side view of a female terminal fitting of the connector.
Figure 3:
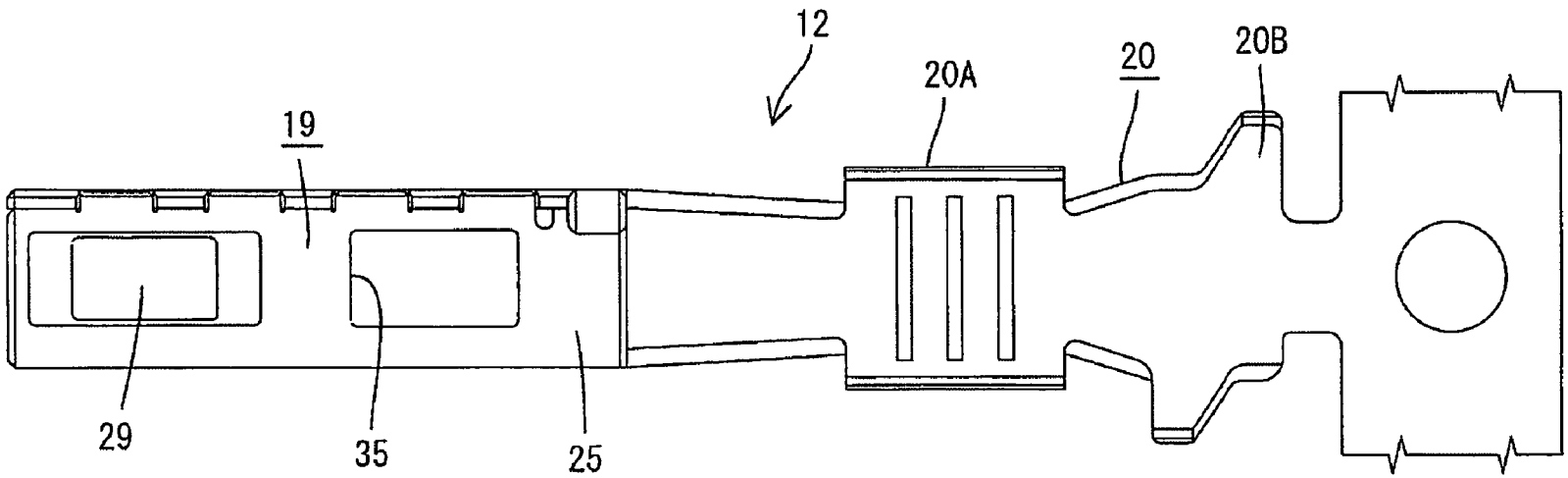
FIG. 3 is a plan view of the female terminal fitting.
Figure 4:
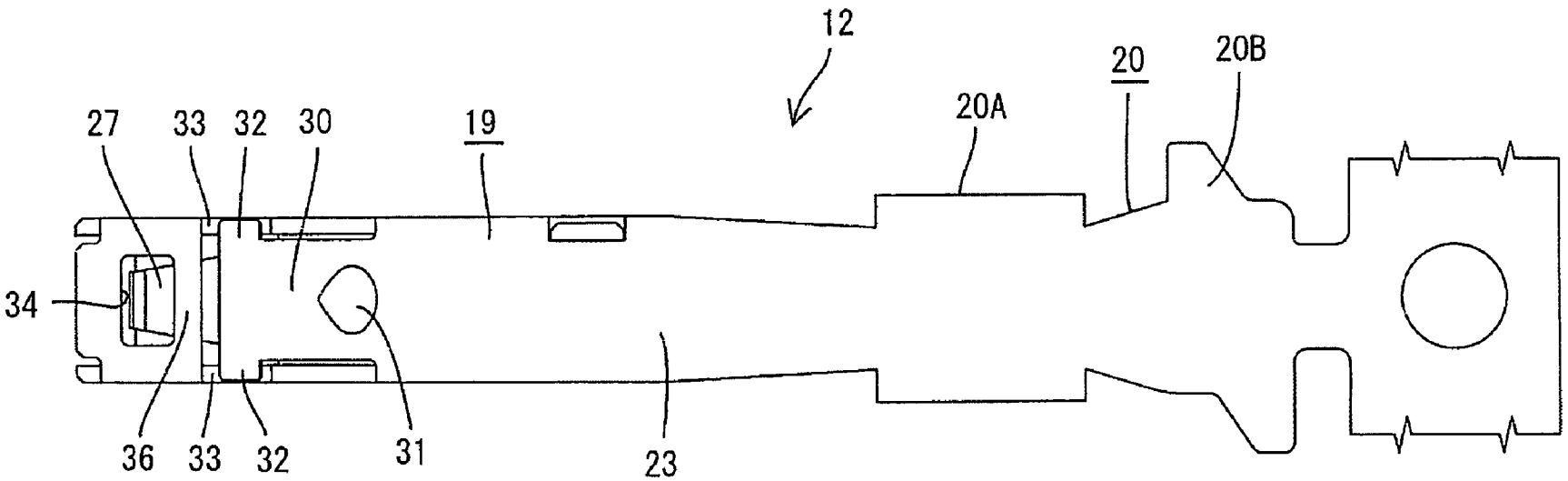
FIG. 4 is a bottom view of the female terminal fitting.

The tube 19 has a base wall 23 that is narrow and long along forward and backward directions, as shown in FIGS. 2 to 4. The base wall 23 is continuous and flush with the base plate of the barrel 20. Side walls 24 project up from opposite lateral edges of the base wall 24, and a ceiling wall 25 extends from the upper end of one side wall 24 to face the base wall 23.

Figure 6:
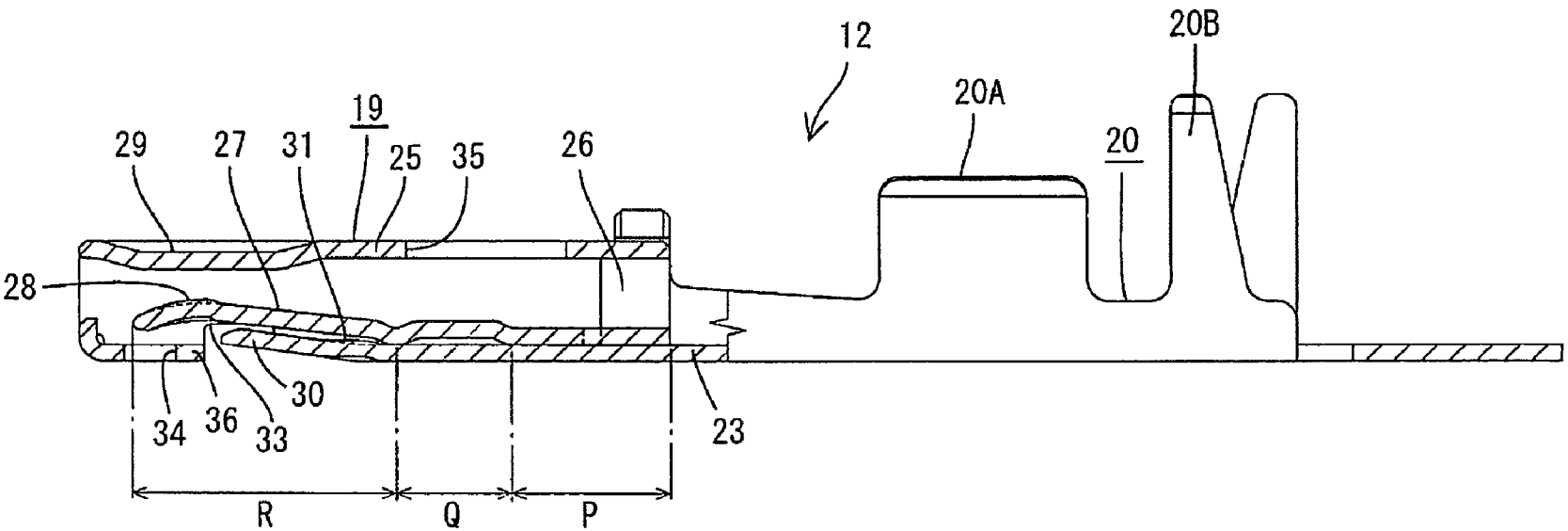
FIG. 6 is a side view partly in section of the female terminal fitting.

A coupling 26 extends down from the rear end of the ceiling wall 25 along one side wall 24, as shown in FIGS. 5 and 6, and a substantially plate-shaped main spring 27 extends along the bottom wall 23 from the bottom end of the coupling 26.

Figure 7:
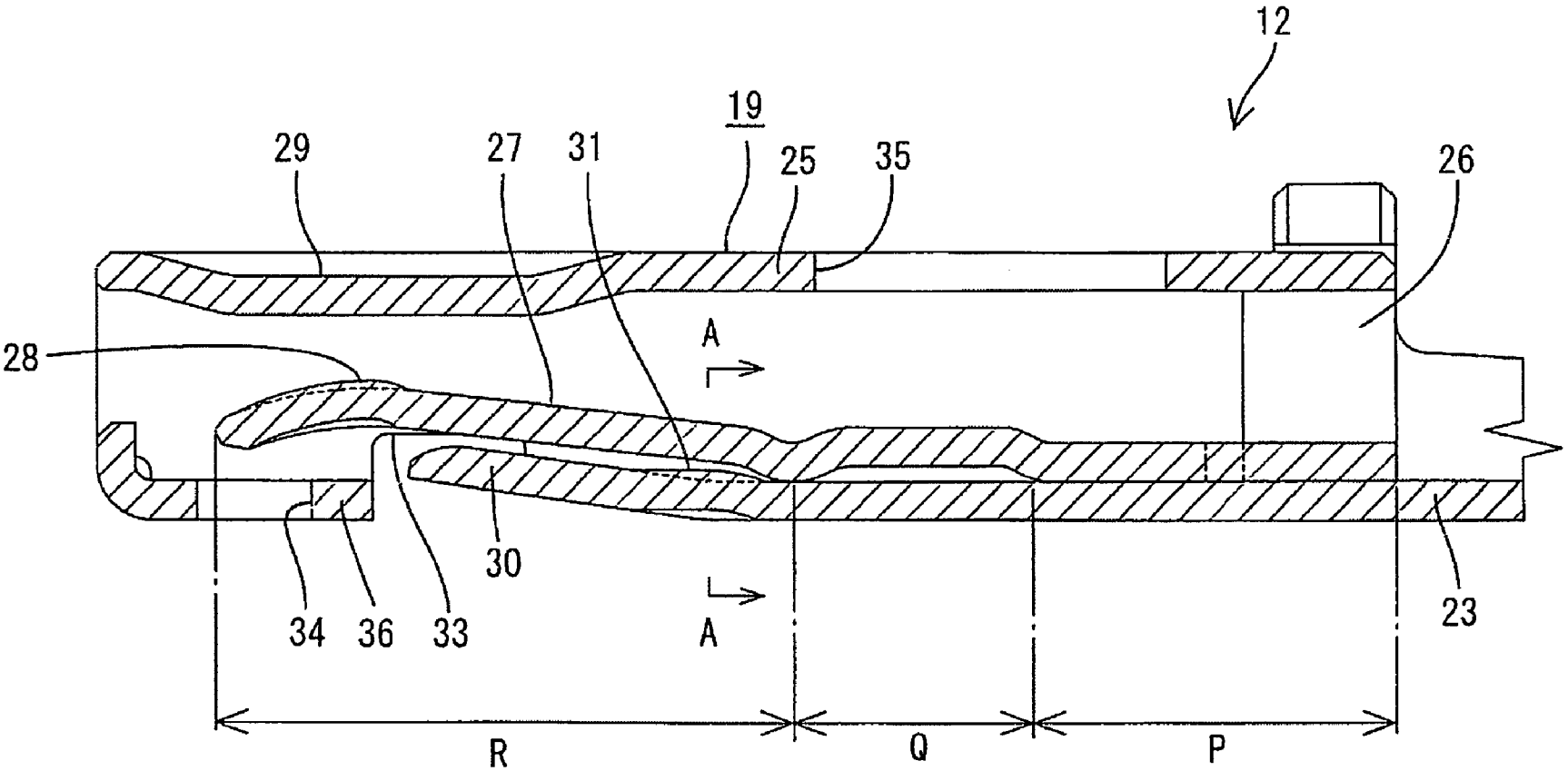
FIG. 7 is an enlarged side view in section of a tube of the female terminal fitting.

The main spring 27 cantilevers forward from the rear end of the tube 19, as shown in FIGS. 6 and 7, and has a first area P that extends forward from the rear end for about one fourth the length of the main spring 27. A second area Q extends from the front end of the first area P and is slightly shorter than the first area P along forward and backward directions. A third area R extends from the front end of the second area Q to the front end of the main spring 27. The main spring 27 contacts the bottom wall 23 in the first area P, is spaced slightly from the bottom wall 23 in the second area Q, and contacts the bottom wall 23 at a boundary between the second and third areas Q and R. The third area R, the main spring 27 extends obliquely up to the front, but a front end of the third area is bent at a large obtuse angle to extend obliquely down to a tip. A contact 28 is embossed and bulges out at the obtuse angle bend. The main spring 27 in the third area R gradually narrows towards the front end.

A substantially rectangular pressure receiving portion 29 is embossed down in an area of the ceiling wall 25 above the contact 28 of the main spring 27, as shown in FIGS. 3 and 6, to ensure a contact pressure between the contact 28 and the male terminal fitting 10. A distance between the pressure receiving portion 29 and the contact 28 in the undeformed state is less than the thickness of the mating terminal fitting 10. A locking hole 35 is formed behind the pressure receiving portion 29 and engages the lock 17 to retain the female terminal fitting 12.

An intermediate portion of the base wall 23 is cut and bent to form a substantially rectangular auxiliary spring 30 that cantilevers obliquely up and in to the front (see FIG. 5). The auxiliary spring 30 is exposed at the bottom of the tube 19. Additionally, the auxiliary spring piece 30 extends along the lower surface of the third area R of the main spring 27 substantially at the same angle of inclination as the main spring 27 and over a distance of more than about half of the extension of the third area R. The front end of the auxiliary spring 30 is slightly obliquely behind the contact 28 of the main spring 27.

The main spring 27 and the auxiliary spring 30 are spaced from each other when they are both in their natural states and not resiliently deformed. However, the lower surface of the main spring 27 contacts the front end of the auxiliary spring 30 from above when the main spring piece 27 is deformed resiliently down and out (see FIGS. 2 and 8).

A bulge 31 is embossed up and in at a base end of the auxiliary spring 30 and a portion adjacent thereto. The bulge 31 enhances the rigidity of the auxiliary spring 30 (see FIGS. 7 and 9). The bulge 31 is substantially rounded to define the shape of a water drop and is distanced from the main spring 27 when the main spring 27 and the auxiliary spring 30 are undeformed.

Two stoppers 32 project out laterally in a common plane from front portions of the left and right edges of the auxiliary spring 30. Left and right receiving portions 33 are formed at the edges of the opening that is left in the base wall 23 by forming the auxiliary spring 30 and the stoppers 32. The receiving portions 33 are at boundaries between the bottom wall 23 and the left and right walls 24 at positions corresponding to the stoppers 32. The stoppers 32 are below the receiving portions 33 when the auxiliary spring 30 is not deformed, but contact the receiving portions 33 from below if thrust up by external matter. This contact prevents the auxiliary spring 30 from being excessively deformed up towards the main spring 27. The stoppers 32 do not bulge out from the side walls 24 of the tube 19, as shown in FIG. 8.

Figure 8:
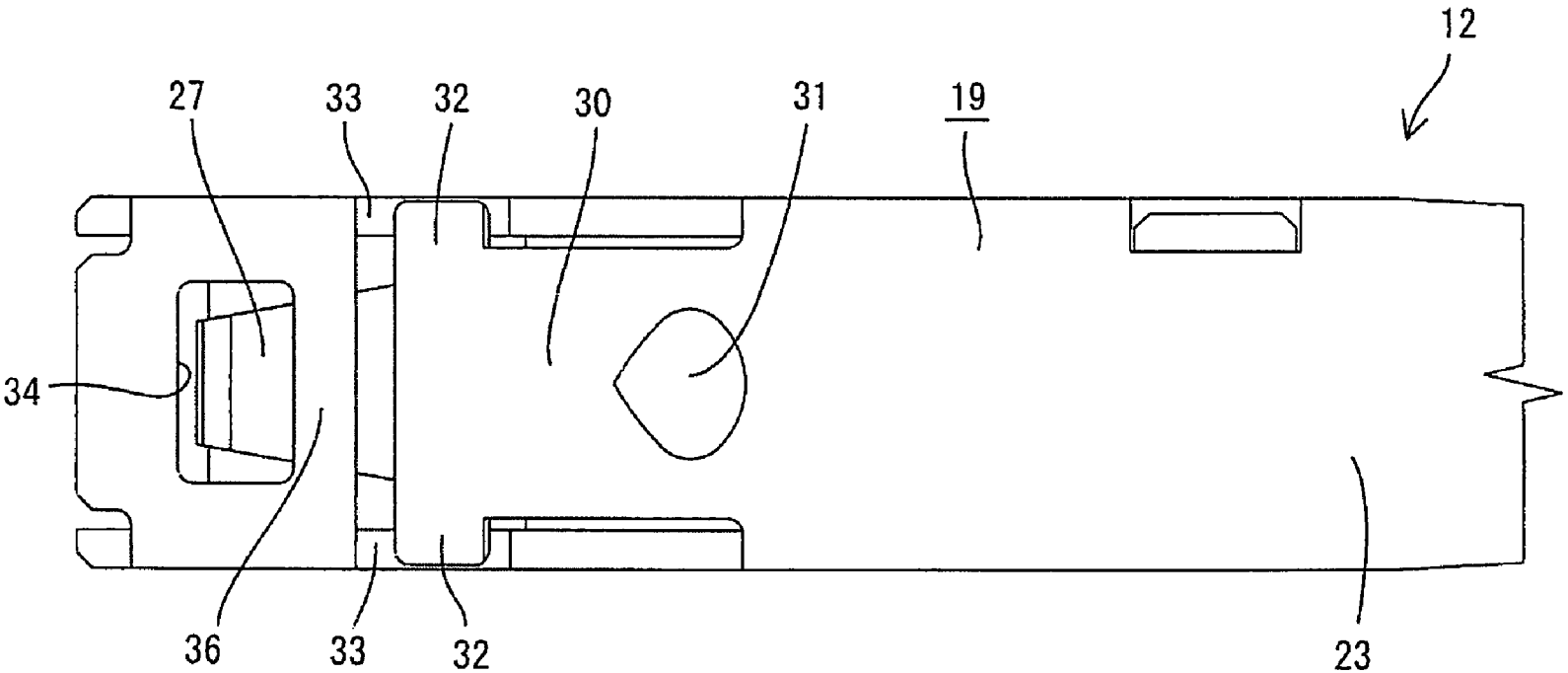
FIG. 8 is an enlarged bottom view of the tube.
Figure 9:
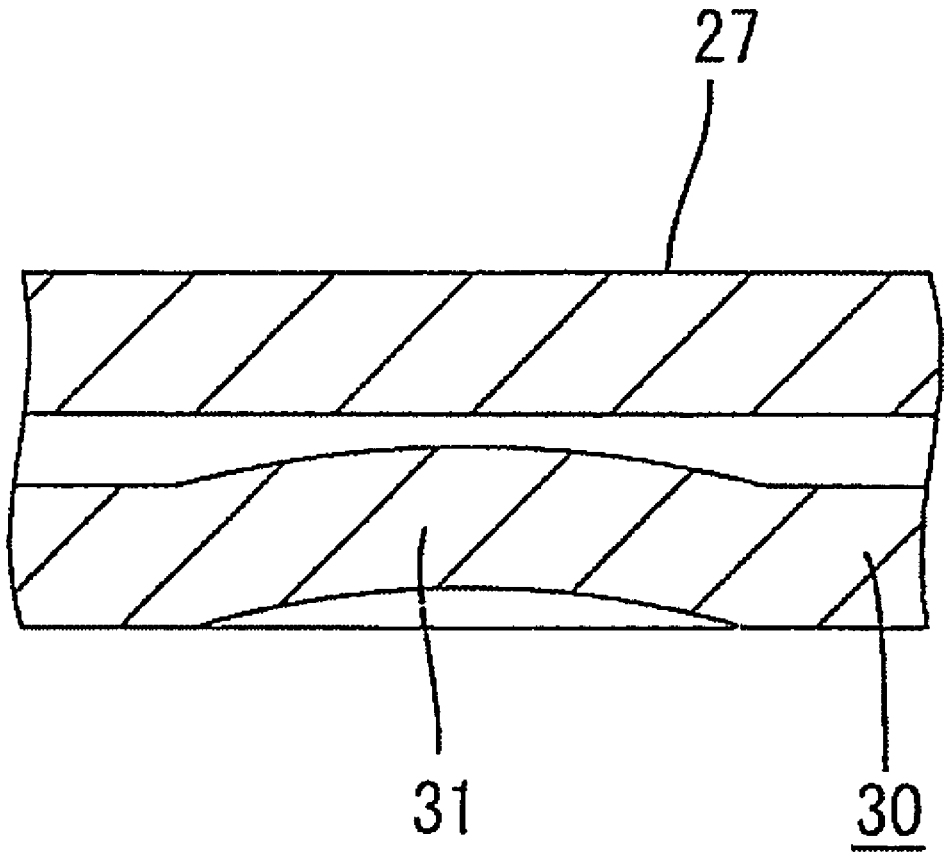
FIG. 9 is a section along 9—9 of FIG. 7.

As shown in FIGS. 7 and 8, a substantially rectangular escaping hole 34 is formed in a part of the base wall 23 before the auxiliary spring 30 and below the front end of the main spring piece 27. The escaping hole 34 avoids interference with the front end of the main spring 27 when the main spring 27 is deformed resiliently down and out. An excessive deformation preventing portion 36 is defined in area of the base wall 23 substantially corresponding to the contact 28 of the main spring 27 for contacting the lower surface of the main spring 27 from below or outside to prevent excessive deformation.

The female terminal fitting 12 is inserted into the cavity 15 of the female housing 13. The lock 17 then engages the locking hole 35 to retain the female terminal fitting 12. At this time, the tube 19 and the wire barrel 20A of the female terminal fitting 12 are accommodated in the cavity 15 before the step 22, and the insulation barrel 20B is accommodated behind the step 22.

The retainer 18 is mounted from below after the female terminal fittings 12 are accommodated in the respective cavities 15. Thus, the retainer 18 engages the rear ends of the tubes 19 to lock the female terminal fittings 12.

The female housing 13 then is fit into the receptacle 14 of the male housing 11 from the front. As the connection progresses, the male terminal fittings 10 enter the tubes 19 through the insertion openings 16 of the female housing 13. The male terminal fittings 10 then engage the contacts 28 of the main springs 27 and deform the main springs 27 down. As a result, the deformed main springs 27 contact the front ends of the auxiliary springs 30 from above and deform the auxiliary springs 30 down and out. Accordingly, resilient forces of the main springs 27 and the auxiliary springs 30 act on the male terminal fittings 10 to squeeze the male terminal fittings 10 between the pressure receiving portions 29 of the ceiling walls 25 of the tubes 19 and the contacts 28 of the main springs 27 to establish electrical connections.

The bulge 31 is formed at the base end of each auxiliary spring 30 by embossing or by providing a thicker wall. Thus, the rigidity of the auxiliary spring 30 is enhanced. In this way, the main spring 27 is reinforced to increase the resilient force on the male terminal fitting 10. Therefore, a high contact pressure is ensured for each male terminal fitting 10.

The bulge 31 is formed merely by embossing the base end of the auxiliary spring 30. Thus, the auxiliary spring 30 is reinforced easily.

The two housings 11, 13 are held connected by an unillustrated known locking mechanism.

According to this embodiment, the outer surfaces of the female housing 13 are cross-sectionally larger at a part corresponding to the insulation barrels 20B, but are cross-sectionally smaller at a part corresponding to the tubes 19 in view of the height differences in the individual female terminal fittings 12. Thus, the part of the female housing 13 corresponding to the tubes 19 is fit in the receptacle 14 of the male housing 11, and the height of the connector is reduced as compared to a case where outer surfaces of the female housing 13 conform with the height of the insulation barrels 20B.

The steps 22 are necessary at the boundaries between the accommodating portions 37A for the tubes 19 and the wire barrels 20A and the accommodating portions 37B for the insulation barrels 20B. Thus, the bottom wall 23 contacts the step 22 if an operator inadvertently tries to insert the female terminal fittings in a vertically inverted posture.

The auxiliary spring 30 is exposed at the bottom wall 23. Thus, there is a possibility that the auxiliary spring 30 will contact the step 22 and be deformed resiliently in a thrust-up direction. However, the auxiliary spring 30 has the stoppers 32 that contact the receiving portions 33 of the tube 19 from below. Thus, the auxiliary spring 30 will not deform excessively.

The female terminal fittings 12 of this embodiment are effective in reducing the height of the female housing 13.

The receiving portions 33 are formed by parts of the opening edge left by cutting and bending the tube 19 to form the auxiliary spring piece 30. Thus, no new processing is necessary to form the receiving portions 33.

The invention is not limited to the above described embodiment. For example, the following embodiments also are embraced by the invention as defined by the claims. Various other changes can be made without departing from the scope of the invention as defined by the claims.

The stoppers 32 are on the auxiliary spring 30 in the foregoing embodiment. However, they may be on the main spring 27 and may contact the receiving portions 33 of the tube 19. In this case, the auxiliary spring 30 may be omitted.

The front end of the auxiliary spring 30 projects sideways along width direction to form the stoppers 32 in the foregoing embodiment. However, the tube 19 may have stoppers 32 instead.

The reinforcing portion is formed by embossing the flat surface of the auxiliary spring 30 to make a round projection in the foregoing embodiment. However, the reinforcing portion may be a long narrow rib.

Although the reinforcing portion is formed by embossing in the foregoing embodiment, it may be formed by cutting and bending.

The reinforcing portion may contact the lower surface of the main spring 27 when the springs 27 and 30 are not deformed.

Although the bulge 31 bulges up and in the foregoing embodiment, the bulge 31 may bulge down and out.

What is claimed is:

1. A terminal fitting, comprising:

a tube for receiving a mating terminal (10);

a spring exposed at a side surface of the tube, the spring including a main spring cantilevered substantially forward in the tube and an auxiliary spring cantilevered substantially forward at an outer side of the main spring, at least one stopper bulging out from at least one side edge of the auxiliary spring; and at least one receiving portion formed on the tube and being defined by an opening edge left in the tube by forming the auxiliary spring, the receiving portion being disposed for contacting the stopper and limiting displacement of the spring into the tube.

2. The terminal fitting of claim 1, wherein the spring has a free front end.

3. The terminal fitting of claim 1, wherein the auxiliary spring is formed by making a cut in a surface of the tube substantially facing the main spring and bending a cut portion.

4. The terminal fitting of claim 1, wherein the spring is cantilevered substantially forward from a rear portion of the tube and has first area extending substantially forward from the rear portion of the tube, a second area (Q) extending from a front end of the first area (P), and a third area (R)

extending from a front end of the second area (Q) to a front end of the spring (27; 30), the spring (27; 30) being substantially in contact with the tube (19) in the first area (P), slightly distanced from the tube (19) in the second area (Q), and substantially in contact with the tube (19) at a boundary between the second and third areas (Q, R).

5. The terminal fitting of claim 1, further comprising at least one reinforcement at the base end of one of the main spring and auxiliary spring for reinforcing at least one of the main spring and auxiliary spring.

6. The terminal fitting of claim 5, wherein the reinforcement comprises a bulge formed by embossing a flat surface of one of the main spring and the auxiliary spring.

7. A connector, comprising:

at least one terminal fitting with opposite front and rear ends, a tube adjacent the front end and configured for receiving a mating terminal, a barrel behind the tube and connectable with a wire, the barrel being cross-sectionally larger than the tube, the terminal fitting having a main spring cantilevered forward in the tube and an auxiliary spring cantilevered forward on the tube and disposed outwardly from the main spring, the auxiliary spring including at least one stopper, and the tube including at least one receiving portion disposed for contacting the stopper and limiting displacement of the auxiliary spring into the tube; and a housing with opposite front and rear ends, at least one cavity extending into the rear end of the housing and continuing substantially to the front end of the housing, the cavity having a cross-sectionally small tube-receiving portion substantially adjacent the front end of the housing for receiving the tube of the terminal fitting, a cross-sectionally large barrel-receiving portion substantially adjacent the rear end of the housing for receiving the barrel of the terminal fitting and a step between the cross-sectionally large barrel-receiving portion of the cavity and the cross-sectionally small tube-receiving portion of the cavity, portions of the housing corresponding to the tube-receiving portion of the cavity being cross-sectionally smaller than portions of the housing corresponding to the barrel-receiving portion of the cavity.

8. The connector of claim 7, further comprising a mating housing with a receptacle, the mating terminal projecting into the receptacle, portions of the housing corresponding to the tube-receiving portion being dimensioned cross-sectionally for insertion into the receptacle, portions of the housing corresponding to the barrel-receiving portion having an external cross-section substantially corresponding to an external cross-section defined by the mating housing.

9. The connector of claim 7, wherein the terminal fitting has a substantially planar base wall, the barrel projecting from the base wall in a direction substantially normal to the base wall a distance greater than a projection of the tube from the base wall in a direction substantially normal to the base wall.

* * * * *